United States Patent [19]

Welker et al.

[11] Patent Number: 4,685,308

[45] Date of Patent: Aug. 11, 1987

[54] TEMPERATURE RESPONSIVE COOLING APPARATUS

[76] Inventors: Mark L. Welker, 13742 Rampchester, Houston, Tex. 77015; Robert M. Stearns, 1335 Silverado, #2502, Houston, Tex. 77077

[21] Appl. No.: 676,653

[22] Filed: Nov. 30, 1984

Related U.S. Application Data

[63] Continuation-in-part of Ser. No. 626,661, Jul. 2, 1984, Pat. No. 4,542,627.

[51] Int. Cl.[4] ..... F28D 3/00

[52] U.S. Cl. ..... 62/171; 62/305

[58] Field of Search ..... 62/305, 183, 171, 304; 251/118; 137/87; 261/69 R, DIG. 15

[56] References Cited

U.S. PATENT DOCUMENTS 4,028,906 6/1977 Gingold et al. ..... 62/305

4,274,266 6/1981 Shires ..... 62/305

*Primary Examiner*—Henry A. Bennet

*Attorney, Agent, or Firm*—Alton W. Payne

[57] ABSTRACT

A temperature responsive cooling apparatus for an air conditioner or a refrigeration system for reducing the cost of operation and maintenance without utilizing electricity, without the need of a supply of fluid that is specially pressurized and without the deposition of nonevaporative components associated with the pretreated fluid. The air conditioner or refrigeration system has an air cooled coil and means for producing a current of air for cooling the coil. The temperature responsive cooling apparatus comprises: (a) a reservoir of fluid, (b) means for transferring the fluid from the reservoir to the temperature responsive cooling apparatus, (c) a fluid control device activated by the current of air for cooling the coil (d) a temperature activated device for terminating and initiating the flow or fluid therethrough in an intermittent fashion for enhancing the operability of the compressor associated with the refrigeration system and for reducing the quantity of water required to cool the coil of the refrigeration system, (e) a fluid treatment device for affecting the nonevaporative components of the fluid prior to engaging the fluid with the coil to prevent, to inhibit or to mitigate the deposition of the nonevaporative components on the coil, (f) means for pretreating the coil with nonfouling material prior to engaging the coil with the fluid, and (g) means for disbursing the fluid to the coil.

20 Claims, 10 Drawing Figures

TEMPERATURE RESPONSIVE COOLING APPARATUS

CROSS-REFERENCE TO RELATED APPLICATION

The present application is a continuation-in-part application of the application to Mark L. Welker, U.S. Ser. No. 626,661, filed July 2, 1984, now U.S. Pat. No. 4,542,627 entitled "temperature responsive cooling apparatus for Air Conditioner and Refrigeration Systems."

FIELD OF THE INVENTION

The present invention relates generally to cooling systems. Specifically, the present invention relates to a temperature responsive cooling apparatus and a kit of parts for assembling a temperature responsive cooling apparatus to be used in conjunction with an air conditioner, a refrigeration system and the like having an air cooled coil and means for producing a current of air for cooling the coil such that the temperature responsive cooling apparatus intermittently disperses a fluid to the air cooled coil for further cooling the coil or terminates the flow of water if the ambient temperature dictates and for increasing the efficiency of the air conditioner thereby reducing the cost of operating and maintaining the air conditioner without damaging the air conditioner, without the deposition of nonevaporative components, without an excessive flow of fluid, and without the aid of a pressure reduction device between the water reservoir and the apparatus.

BACKGROUND OF THE INVENTION

Devices that provide additional cooling to air conditioners, refrigeration systems and the like are known in the art. Specifically, systems are known for cooling the air cooled condenser coils of an air conditioner with a water mist or vapor to lower the temperature of the coil by evaporative cooling and by conductive cooling and thereby improving the efficiency of the air conditioner. All of the known systems have difficulties. The most critical of the problems associated with the known systems is the depositon upon the coils of nonevaporative components within the sprayed water. The evaporative cooling caused by the evaporation of the water is used in addition to the conductive cooling of the coils by the water and the cooling of the coils by the air to better extract heat from the coils. When the water evaporates, the nonevaprative components of the water tend to adhere to the surface of the coils. Typically, the adhesion of the nonevaporative components of the water causes an excessive buildup of the components on the coils. The excessive buildup of the nonevaporative components reduces the cooling effeciency of the coils regardless of whether the coil is cooled by air, by evaporative cooling or by conductive cooling.

Since water or some other fluid is used as an evaporating agent on the air cooled coils, a reservior of water or fluid must be provided. The pressure with which water is provided from the reservoir can cause problems to many of the presently known devices for cooling the air cooled coils of refrigeration systems. If the pressure of the water is insufficient, the flow of water to the coils may not provide sufficient cooling to significantly increase the efficiency of the air conditioner. Alternately, if (1) the pressure of the water is sufficiently high to continuously contact the coils with water and (2) the heat load on the refrigeration system is adequate to cause sufficient evaporation, then, typically, a high rate of deposition of nonevaporative components of the water will deposit on the coils. Also, the cooling device itself may not be able to handle water provided at excessively high pressures without a pressure reduction device. Most valves adaptable for such use are inoperable when engaged with water at high pressures, e.g., the valve may not close.

Typically, the prior art utilizes a system of sprayers for directing a specific amount of water on the coils. As explained in U.S. Pat. No. 2,278,242 issued to Robert L. Chapman and assigned to General Electric Company, an evaporative cooler can be developed having an improved arrangement of sprayers for directing the quantity and flow of water contacting the coils. Also, the prior art has used a thermostatically controlled solenoid valve connected in parallel with the electrical circuit which energizes the conpressor motor of the air conditioning system and which activates the solenoid valve which sprays a water vapor or mist upon the coils. An electrically controlled solenoid valve apparatus is disclosed in U.S. Pat. No. 3,872,684 issued to John L. Scott. Other systems have reduced the amount of water contacting the coils to enhance the evaporative cooling and thus the efficiency of the air conditioner system by injecting an atomized mist of minute water particles onto the air cooled coils as described in U.S. Pat. No. 4,028,906 issued to Albert Gingold et al. Additionally, systems such as described in U.S. Pat. No. 4,170,117 issued to Robert Faxon utilize a temperature sensing device for activating or deactivating a fluid control valve which sprays water onto the air cooled coils of an air conditioner. To eliminate the need for an electrical connection, an air activated valve is described in U.S. Pat. No. 4,274,266 issued to Donald Shirers which operates by the air current passing across the coils engaging the air activayed valve and which accepts a controlled pressurized water source to provide a water spray onto the condenser coils. More recent and more complicated systems encompass units which must be attached to the air conditioner, contain reservoirs for the recirculation of water and must be plugged into an outdoor electrical outlet to be actuated only when the condensing unit itself is in operation as determined by a pressure sensitive device. Such a complicated system is described in U.S. Pat. No. 4,353,219 issued to Robert Patrick, Jr.

There is thus a need for a temperature responsive cooling apparatus which can be easily connected to an air conditioner, a refrigeration system and the like, which, at the same time accepts water at conventionally available pressures, which is adapted for use without any electrical connections, and which is inexpensive.

It is, therefore, a feature of the present invention to provide a unique temperature responsive cooling apparatus for use with a conventional air conditioner, refrigeration system and the like which reduces the cost of operation and reduces the cost of maintenance without damage and without the deposition of nonevaporative components thereupon.

Another feature of the present invention is to provide a temperature responsive cooling apparatus for an air conditioner or refrigeration system which is operable without utilizing electricity, batteries or any other source of power.

Yet another feature of the present invention is to provide a temperature responsive cooling apparatus for an air conditioner or refrigeration system which accepts water from water sources at any conventional pressure.

Yet another feature of the present invention is to provide a temperature responsive cooling apparatus for an air conditioner or refrigeration system with automatic intermittent operation for providing more efficient cooling, for maintaining the air conditioner or refrigeration system at optimal operating conditions, and for dissiminating greatly reduced quantities of fluid. The automatic intermittent operation is controlled by the temporal operating characteristics of the air conditioner or refrigeration system.

Yet another feature of the present invention is to provide a temperature responsive cooling apparatus for an air conditioner or refrigeration system for terminating the flow of water when the ambient temperature reaches a predetermined value to reduce the probability of chilling the evaporator coil of the refrigeration system thereby reducing the probability of freezing or flooding the evaporator and reducing the need for removing the apparatus when not in use.

Yet still another feature of the present invention is the provide a temperature responsive cooling apparatus for an air conditioner or refrigeration system which can be purchased as a kit and easily assembled without the aid of special tools or expertise.

Additional features and advantages of the invention will be set forth in part in the description which follows, and in part will become apparent from the description, or may be learned by practice of the invention. The features and advantages of the invention may be realized by means of the combinations particularly pointed out in the appended claims.

SUMMARY OF THE INVENTION

To achieve the forgoing features and advantages, and in accordance with the purposes of the invention as embodied and described herein a temperature responsive temperature responsive cooling apparatus is provided for reducing the cost of operating and maintaining an air conditioner or a refrigeration system having an air cooled coil and means for producing a current of air for cooling the coil without utilizing electricity, without the need of a supply of fluid that is specially pressurized and without the deposition of nonevaporative components of the fluid thereupon which comprises: (a) a reservoir of fluid, (b) means for transferring the fluid from the reservoir to the temperature responsive temperature responsive cooling apparatus, (c) a fluid control device mounted on the air conditioner or refrigeration system and activated by the current of air for cooling the coil, the fluid control device directly engages the flow of and the pressure of the fluid from the reservoir for restricting the flow of the fluid therethrough when the current of air for cooling the coil is not operative and for permitting the flow of fluid therethrough when the current of air for cooling the coil is operative, (d) a temperature activated device for terminating and initiating the flow of fluid therethrough in an intermittent fashion for enhancing the operability of the compressor associated with the refrigeration system and for reducing the quantity of fluid required to cool the coil of the refrigeration system, (e) a fluid treatment device for affecting the nonevaporative components of the fluid prior to engaging the fluid with the coil to prevent, to inhibit or to mitigate the deposition of the nonevaporative components on the coil and to prevent the corrosion of the coil, (f) means for coating the coils to prevent fouling prior to engaging the coils with the fluid, and (g) means for dispersing the fluid to the air cooled coil from the fluid control device for further cooling the coil and increasing the efficiency of the air conditioner or the refrigeration system, and, optionally, (h) means for cleaning the coil prior to spraying the silicone thereupon and prior to dispensing the fluid thereto.

In accordance with another embodiment of the present invention, a combination of components can be adapted for assembly together as a temperature responsive cooling apparatus for providing additional cooling to an air conditioner or a refrigeration system having an air cooled coil and means for producing a current of air for cooling the coil, the components of the temperature responsive cooling apparatus comprising as cooperative parts thereof: (a) a conduit for transferring a fluid from a reservoir, (b) a fluid control device to be mounted on the air conditioner and to be exposed to the current of air which cools the coil, the fluid control device directly engages the flow of and the pressure of the fluid transferred by the conduit for restricting the flow of fluid when the current of air for cooling the coil is not operative and for permitting the flow of fluid when the current of air for cooling the coil is operative, (c) a fluid treatment device associated with the conduit and the fluid control device for affecting the nonevaporative components of the fluid prior to engaging the fluid with the coil to prevent, to inhibit or to mitigate the deposition of the nonevaporative components on the coil and to prevent the corrosion of the coil, (d) a temperature activated device for terminating and initiating the flow of fluid therethrough in an intermittent fashion for enhancing the operability of the compressor associated with the refrigeration system and for reducing the quantity of fluid required to cool the coil of the refrigeration system, (e) a device for covering the coil with nonfouling material prior to engaging the coil with fluid for preventing the nonevaporative components in the fluid from depositing on the coil, (f) one or more conduits for transferring the fluid from the fluid control device and (g) one or more spray nozzles associated with the conduits for dispersing the fluid to the air cooled coil, for cooling the coil and for increasing the efficiency of the air conditioner or refrigeration system, and, optionally, (h) means for cleaning the coil prior to covering the coil with nonfouling material and prior to dispersing the fluid on the coil, such that when the components are connected the fluid passes from the reservoir through the conduit, through the fluid treatment device and directly engages the fluid control device, if the fluid control device is not activated by the current of air then the fluid is restricted from flowing, if the fluid control device is activated by the current of air then the fluid passes through the fluid control device, through the one or more conduits to the spray nozzles through the spray nozzels and onto the silicone-coverd coil for providing additional cooling to the coil thereby reducing the cost of operating and maintaining the air conditioner or refrigeration system without damaging the air conditioner or refrigeration system and without the deposition of nonevaporative components thereupon.

BRIEF DESCRIPTION OF THE DRAWINGS

The accompanying drawings which are incorporated in and constitute a part of the specification, illustrate a preferred embodiment of the invention and, together with the general description of the invention given above, and the detailed description of the preferred embodiment given below, serve to explain the principles of the invention.

The above general description and the following detailed description are merely illustrative of the generic invention, and additional modes, advantages and particulars of this invention will be readily suggested to those skilled in the art by the following detailed description.

DETAILED DESCRIPTION OF THE PREFERRED EMBODIMENT

Reference will now be made in detail to a presently preferred embodiment of the invention as illustrated in the accompanying drawings.

Figure 1:
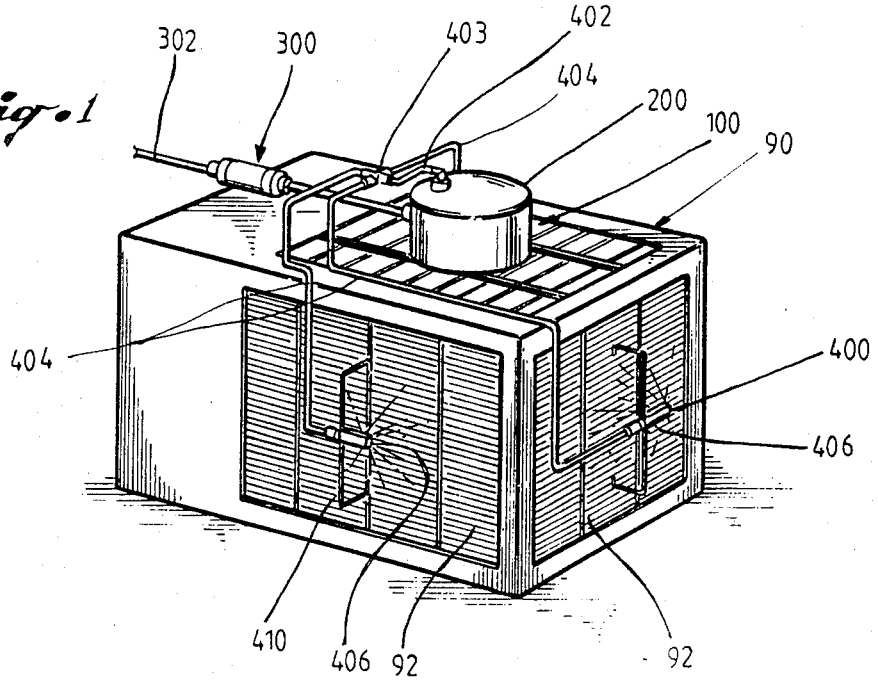
FIG. 1 is a perspective view illustrating a preferred embodiment of the temperature responsive cooling apparatus of the present invention connected to a conventional air conditioning unit without the temperature activated device.

FIG. 1 is an illustration of a temperature responsive cooling apparatus 100 connected to an air conditioner 90. The temperature responsive cooling apparatus 100 primarily comprises the fluid control device 200, the fluid treatment member 300, the nozzles and associated mounting members 406 and 400, respectively, and the temperature activated device 500. The fluid control device 200 has an inlet conduit 304 and a outlet conduit 402. The inlet conduit 304 is connected to the fluid treatment member 300, which is connected to a conduit 302, which is connected to a temperature activated device 500, which, in turn is connected to a reservoir. The reservoir for the illustrated system is a conventional spigot. The outlet conduit 402 is connected to a joint 403. The joint 403 connects the auxiliary conduits 404 to the outlet conduit 402. Each auxiliary conduit 404 is connected at its extremity to a nozzel mounting member 400. The nozzel mounting member 400 is shown with the wire 410 connecting the nozzel mounting member 400 to the air conditioner 90 and the nozzels 406 focused on the air cooled coils (not illustrated) behind the gratings 92 of the air conditioner 90.

Figure 2:
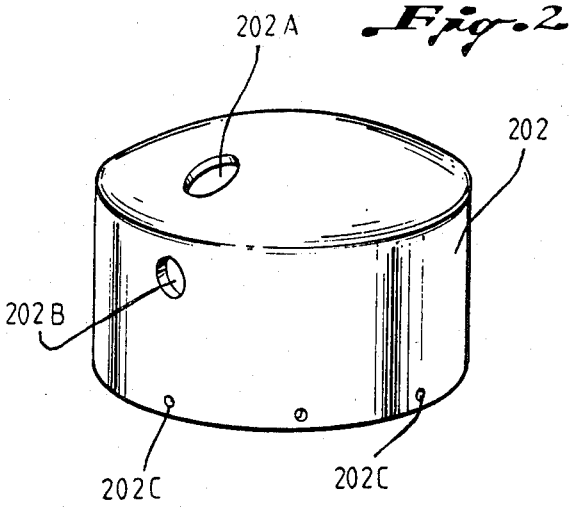
FIG. 2 is a side view illustrating a preferred embodiment of the housing member of the temperature responsive cooling apparatus of the present invention.

FIG. 2 illustrates a side view of the housing member 202 of the fluid control device 200 of the present invention. The housing member 202 has appature 202A through which the fluid flows out of the housing member 202. Also, the housing member 202 has appature 202B through which the fluid flows into the housing member 202. The appatures 202C are used to secure the housing member 202 to the air conditioner 90. Preferrably, the housing member 202 can be secured to the air conditioner 90 using the plastic ties 416 (see FIG. 6) or any other flexible member that can pass through the aperatures 202C and around the gratings 92 of the air conditioner 90 (see FIG. 1).

Figure 3:
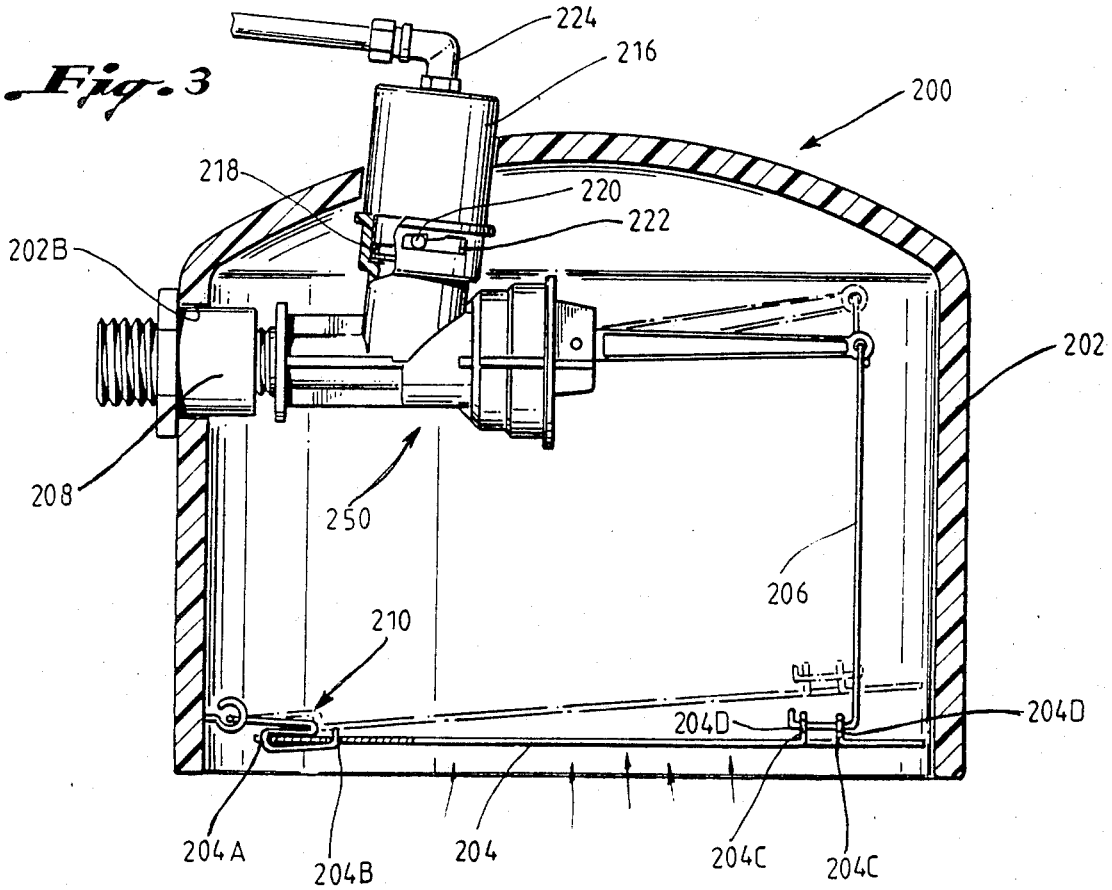
FIG. 3 is a cross-sectional, exploded view of the fluid control device of a preferred embodiment of the temperature responsive cooling apparatus of the present invention.

FIG. 3 is a cross-sectional, exploded view of the fluid control device 200. The fluid control device 200 is encompassed by the housing member 202. The valve member 250 engages the housing member 202 through the appature 202B. The valve member 250 is oriented to extend upward toward the domed portion of the housing member 202. The locking slot 222 in the valve member 250 accepts the locking pin 220 in the connecting member 216 for removably securing the connecting member 216 to the valve member 250. The O-ring 218 provides a secure seal between the connecting member 216 and the valve member 250. The elbow 224 fixedly engages the connecting member 216. The elbow 224 engages the main outlet conduit 402 and the adaptor 208 can be engaged with the valve member 250 for accepting different sizes of the inlet conduit 304 (see FIG. 1).

As illustrated in FIG. 1 and FIG. 3, the valve member 250 is operated by the driver member 204 being engaged by a vertical current of air expelled from the air conditioner 90. The driver member 204 is oriented to be essentially orthogonal to the force lines (not illustrated) typically associated with the attraction of gravity. When the driver member 204 is pushed by the vertical current of air, the driver member 204 overcomes the attraction of gravity and pivots about the pivot member 210. The movement of the driver member 204 causes the linkage member 206 to engage the valve member 250. If the vertical air current is not engaging the driver member 204, the attraction of gravity upon the driver member 204 and the linkage member 206 returns the driver member 204 and the linkage member 206 back to their associated positions prior to being displaced by the current of air.

However, there is no requirement to always mount the driver member 204 orthogonal to the force of gravity. Indeed, the driver member 204 can even be mounted parallel to the force of gravity. If mounted parallel to the force of gravity, the driver member 204 can be returned to the closed or undisplaced position by using a spring (not illustrated). The spring can be attached to the driver member 204 and to an extreme portion of the housing member 202 opposite the domed portion thereof. As another alternative, the fluid control device 200 can be mounted to orient the driver member 204 at such an angle to the force of gravity to cause the driver member 204 to be sufficiently acted upon by the force of gravity to return the driver member 204 to the closed or undisplaced position.

Figure 4:
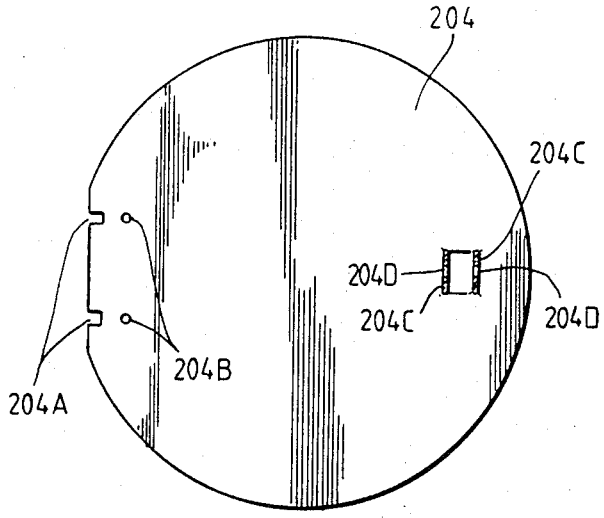
FIG. 4 is a plan view of the driver member of a preferred embodiment of the temperature responsive cooling apparatus of the present invention.

FIG. 4 is a plan view of the driver member 204 of the present invention. At one extremity of the driver member 204 the grooves 204A are cut therein. Adjacent the grooves 204A and interior of the driver member 204 are the apertures 204B. The groves 204A and the apertures 204B accept the pivot member 210 to secure the pivot member 210 to the driver member 204. At the opposite side of the driver member 204 from the grooves 204A and from the apertures 204B, the flaps 204C are cut into the driver member 204. In each of the flaps 204C is an aperture 204D. The flaps 204C are pushed up out of the plane of the driver member 204 such that the apertures 204D form a channel. The channel formed by the apertures 204D accept the linkage member 206 as illustrated in FIG. 3 for securing the linkage member 206 to the driver member 204.

Figure 5:
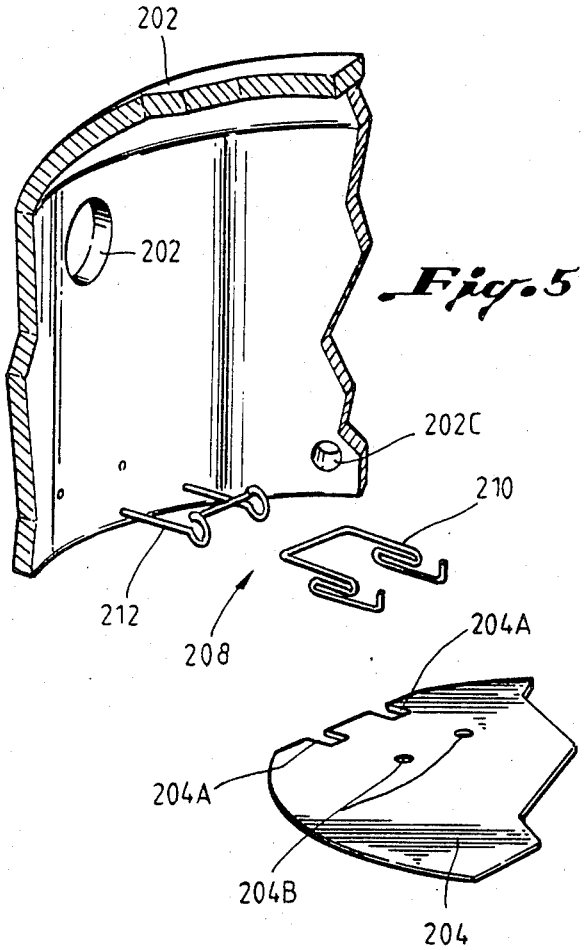
FIG. 5 is and exploded view illustrating the pivot member of a preferred embodiment of the temperature responsive cooling apparatus of the present invention.

FIG. 5 is an exploded view illustrating the pivot member 208. The pivot member 208 comprises the embedded member 212 and the rotating member 214. The embedded member 212 is fixedly secured to the housing member 202. The rotating member 214 is rotatively engaged with the embedded member 212 and is removably engaged with the driver member 204. The connection of the embedded member 212 and the rotating member 214 provides a means about which the driver member 204 pivots.

Figure 6:
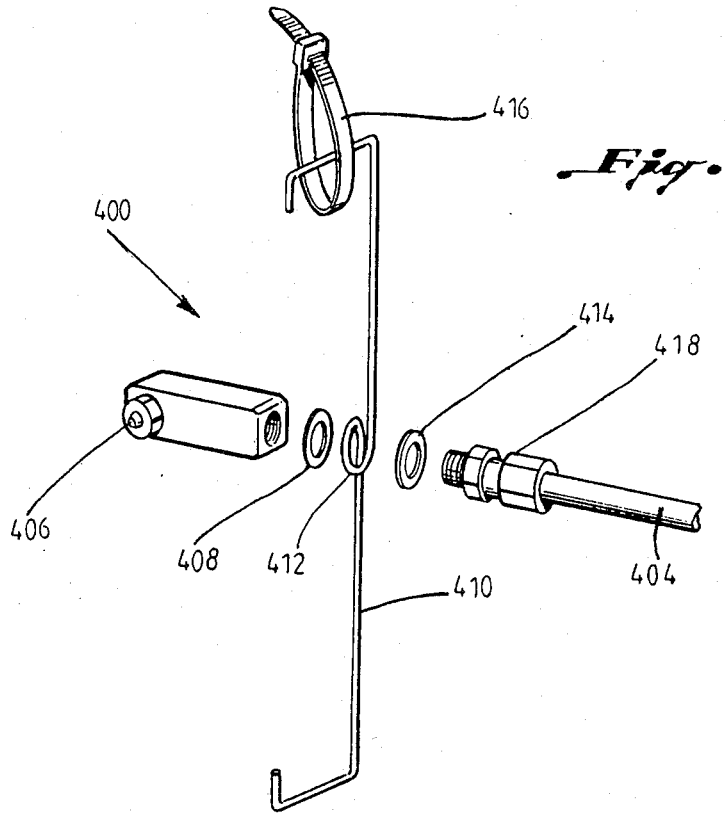
FIG. 6 is an exploded, perspective view illustrating the nozzel mounting member of a preferred embodiment of the temperature responsive cooling apparatus of the present invention.

FIG. 6 is an exploded perspective view illustrating the nozzle mounting member 400. Th nozzle mounting member 400 is used to secure the position of the nozzle 406 to the air conditioner 90 to allow a directed stream of fluid mist to engage the coils (not illustrated) inside the air conditioner 90. The nozzle 406 is engaged with a stainless steel wire 410 using a washer 408, an eyelet 412, a washer 414 and a fitting 418. The fitting 418 is connected to the auxiliary outlet tube 404 through which the fluid flows. The wire 410 can be bent to conform to any desired shape. Also, the wire 410 can be engaged with the air conditioner 90 to position the nozzle 406 at any desired location. The wire 410 is secured in the desired location using the plastic ties 416. It should be readily appreciated that the nozzle mounting member 400 can be configured in many and numerous forms as well as being composed of different materials.

Figure 7:
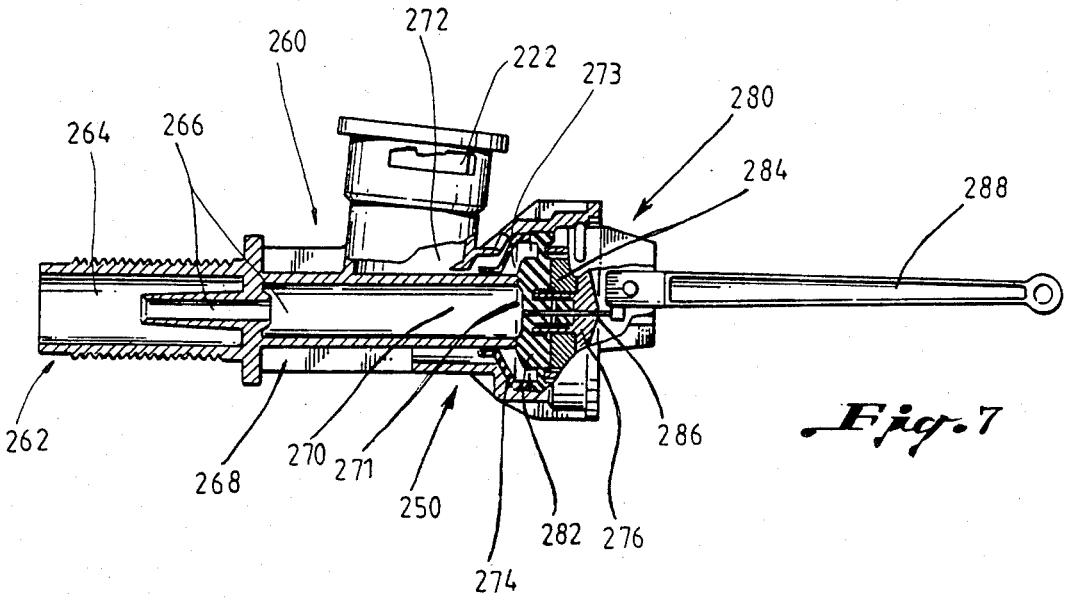
FIG. 7 is a cross-sectional view of the valve member of a preferred embodiment of the temperature responsive cooling apparatus of the present invention.

FIG. 7 is a cross-sectional view of the valve memeber 250. The valve member 250 comprises the flow assembly 260 and the control assembly 280. The fluid enters the valve member 250 through the intake chamber 264 and passes into the high pressure region 266. The high pressure region 266 increases in volume to create the low pressure region 270. The low pressure region 279 is engaged at the open end 271 by the first gasket 274. The gasket 274 surrounds the open end 271 of the low pressure region 270 and closes the open end 273 of the exhaust chamber 272. The control assembly 280 is manipulated by the lever 288. The lever 288 is moved by the linkage member 206 (see FIG. 3). The lever 288 moves a rod 286 through the center of the control assembly 280. The rod 286 engages a second gasket 282. The gasket 282 is supported by the rigid annular member 284.

It is the rigid annular member 284 that allows the valve member 250 to be engaged by high pressure and continue to open and close the flow of water therethrough. The valve member 250 can be purchased from Fluid Master, Inc., 1800 Via Burton, P.O. Box 4264, Anaheim, CA 92803. The commercially available valve must be modified by placing a specially sized rigid annular member or washer 284 behind the second gasket 282. All of the operating characteristics of the valve member 250 are improved for the present purpose by adding the ridid annular member 284.

Figure 8:
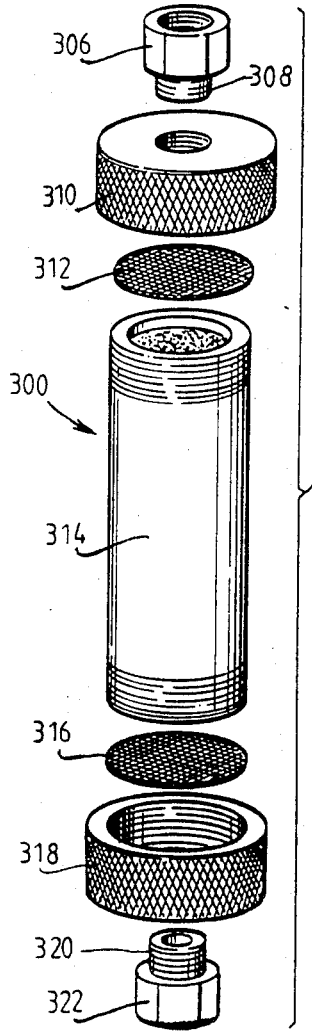
FIG. 8 is across-sectional view illustrating a preferred embodiment of the filter device of the temperature responsive cooling apparatus of the present invention.

FIG. 8 is across-sectional view illustrating one embodiment of the fluid treatment device 300 of the temperature responsive cooling apparatus 100 of the present invention. The fluid treatment device 300 comprises the cylindrical casing 314 engaged at both end by the end members 310, 318 and the connectors 306, 322, respectively. The end members 310, 318 are removably engaged with the casing 314 using threads. The connectors 306, 322 are removably engaged with the end members 310, 318 using the adaptors 308, 320, respectively. A chemical for preventing the deposition of the nonevaporative components on the coil is contained in the casing 314. The chemical is secured in the casing 314 using the screens 312, 316. The screen 312 is secured by the end member 310 and the casing 314. The screen 316 is secured by the end member 318 and the casing 314. The chemical is held in place by the the casing 314, the screen 312 and the screen 316. Alternately, other means are readily available for securing the various components, e.g., foam can be used to secure the screen 316 in the end member 318.

When using water as the fluid, the preferred chemical to be used with the fluid treatment device 300 as illustrated in FIG. 8 is available from Calgon under the trademark "MICROMET." Also, Calgon sells the chemical under the OEM product name of "1OCL" as well as other product names. Generally, "MICROMET" is a scale and corrosion controlling proprietary chemical of Calgon.

"MICROMET" is available in a 6–8 mesh crystal. Thus, the screens 312 and 316 can be 40 mesh and contain the "MICROMET" crystals within the casing 314. The fluid treatment device 300 is designed to be opened and the "MICROMET" refilled every about 90–120 days when the temperature responsive cooling apparatus 100 is in use.

Alternatively, th fluid treatment device 300 could be any other appropriately functioning device. For example, an in-line "T" strainer device could be used with the MICROMET or other nonfouling material to function as the fluid treatment device 300. Also, a disposable-type device could be used with the nonfouling material as the fluid treatment device 300 in practicing the present invention.

Figure 1A:
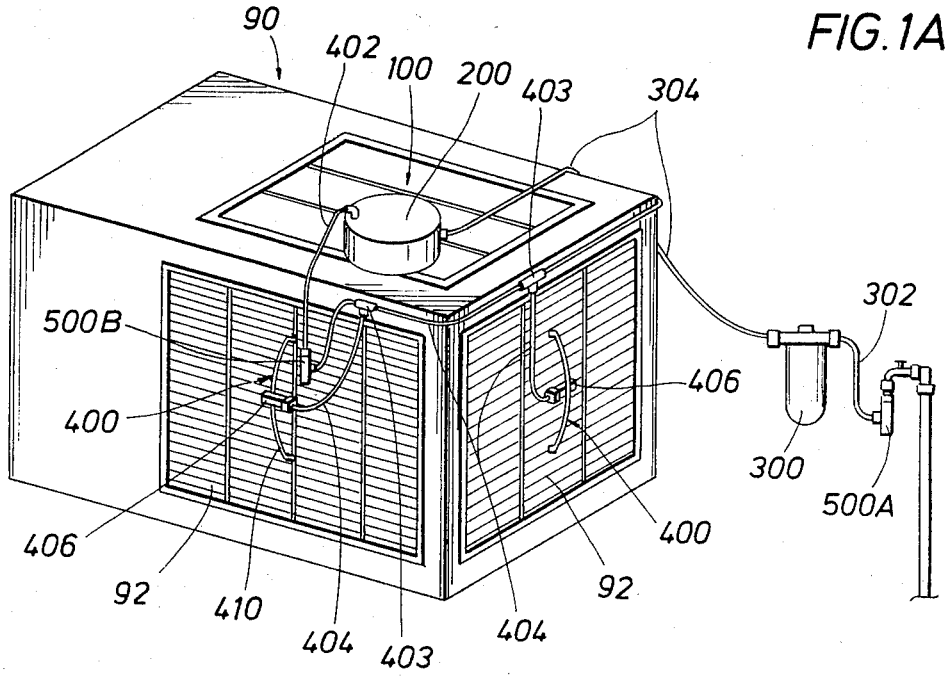
FIG. 1A is a perspective view illustrating a preferred embodiment of the temperature responsive cooling apparatus of the present invention with the temperature activated device as connected to a conventional air conditioning unit.
Figure 9:
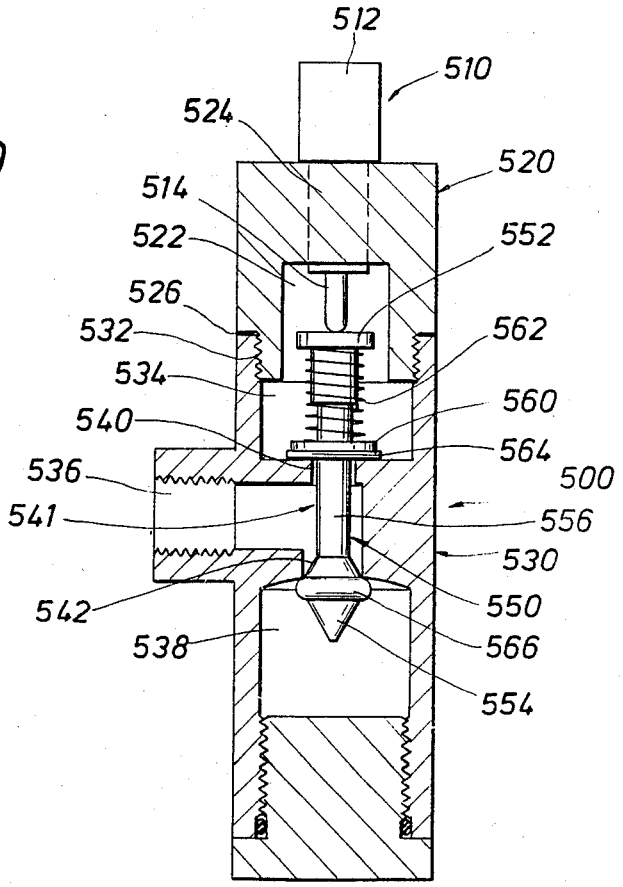
FIG. 9 is a cross-sectional view illustrating a preferred embodiment of the temperature activated device of the temperature responsive cooling apparatus of the present invention.

Similarily, the present invention can be practiced using a reverse osmosis device rather than the specific embodiment of the fluid treatment device 300 as previously discussed. A reverse osmosis device uses the phenomenon of diffusion through a semipermeable membrane. For example, a reverse osmosis device could use a plurality of bundles of polymeric capillaries through which the fluid is forced under pressure to pass. The pure fluid tends to pass through the bundles of polymeric capillaries at a faster rate than the fluid with impurities, i.e., the impurities are restricted from passing therethrough. A reverse osmosis device requires little maintence and removes almost all of the impurities from the fluid. FIGS. 1A and 9 illustrate the temperature responsive cooling apparatus of the present invention in conjunction with the temperature activated device 500A, B. Specifically, FIG. 9 is a cross-sectional veiw illustrating the temperature activated device 500A,B of the temperature responsive cooling apparatus 100 of the present invention. The primary components of the temperature activated device 500A,B ar the temperature sensitive element 510, the sleeve 520, the body 530 and the stem 550. The temperature sensitive element 510 is in movable association with the stem 550 to secure the passage of fluid or to allow the passage of fluid.

The temperature sensitive element 510 comprises a thermostatic actuator as most readily identified with automotive engine thermostats. Specifically, the temperature sensitive element 510 of the present invention is a device trademarked "POWER PILL" by and sold by Robertshaw Controls Company of Knoxville, Tenn. However, it is readily understood that any commercially available thermostatic actuator could be used as the temperature sensitive element 510 of the present invention.

The temperature sensitive element 510 of the present invention comprises an actuator member 512 and a shaft 514. The sleeve 520 has therein a recess 522, an aperture 524 and the threads 526. The temperature sensitive element 510 is fixidly engaged with the aperture 524 of the sleeve 520 such that the shaft 514 of the temperature sensitive element 510 extends into the recess 522 of the sleeve 520.

The body 530 of the temperature activated device 500A,B has therein the threads 532, a first recess 534, an outlet 536, a second recess 538, a first aperture 540 and a second aperture 542. The threads 532 of the body 530 engage the threads 526 of the sleeve 520 for securing the the body 530 to the sleeve 520. The first aperture 540 provides a passage between the first recess 532 and the outlet 536. The second aperture 542 provides a passage between the second recess 538 and the outlet 536.

The stem 550 comprises a shaft 556, a cap end 552 and an expanded end 554. Associated with the stem 550 and the body 530 are the washer 560, the spring 562, the first seal 564 and the second seal 566. The shaft 556 of the stem 550 passes through the first aperture 540 and the second aperture 542 of the body 530. The cap end 552 of the stem 550 engages the shaft 514 of the temperature sensitive element 510. As the shaft 514 of the temperature sensitive element 510 is ingressed and egressed therefrom, the stem 550 is caused to move within the channel 541 created by the first aperture 540 and the second aperture 542 of the body 530.

In the closed mode as illustrated in FIG. 9, the shaft 514 of the temperature sensitive element 510 is ingressed in the temperature sensitive element 510. The spring 562 causes the stem 550 in the channel 541 to be withdrawn into the recess 522 of the sleeve 520. When the stem 550 ingresses in the temperature sensitive element 510, the second seal 566 securedly engages the body 530 to secure the second aperture 542 thereby preventing the passage of fluid therethrough and restricting the flow of fluid from the outlet 536.

In the open mode (not illustrated), the shaft 514 is extended from the temperature sensitive element 510. The second seal 562 is displaced from the second aperture 542 for causing the fluid to flow through the second aperture 542. The spring 562 actively engages the washer 560 for causing the first seal 564 to securedly engage the first aperture 540 to prevent fluid from passing through the first aperture 540 into the first recess 544. In the open mode, the fluid is caused to flow through the outlet 536.

A temperature sensitive element 510 can be selected for which the shaft 514 is caused to egress therefrom at a specific temperature and caused to ingress at another lower temperature. Therefore, the temperature activated device 500A,B terminates and initiates the flow of fluid therethrough in an intermittent fashion. The intermittent flow caused by the temperature activated device 500A,B enhances the operability of the compressor associated with the refrigeration system. Also, the temperature activated device 500A,B reduce the quantity of water required to cool the coil of the refrigeration system.

For example, when using the present invention, a first temperature activated device 500A engaged with the reservoir of water, as illustrated in FIG. 1, can be preset for providing a flow of water therethrough only after the ambient air temperature has exceeded a preset value. Thereafter, the water would pass through the temperature activated device 500A and into the fluid treatment member 300. The treated fluid would pass through the inlet conduit 304 into the fluid control device 200. The fluid control device 200 would allow passage of the fluid only when the fan associated with the refrigeration system is activated. When the fan is activated, the fluid control device 220 provides fluid to the outlet conduit 402 which provides fluid to a second temperature activated device 500B. The second temperature activated device 500B can also be preset to provide fluid flow only after a specified, predetermined temperature in the vicinity of the refrigeration system has been reached. For example, the second temperature activated device 500B could be preset to provide a fluid flow rate when the air temperature in the vicinity of the refrigeration system exceeds 95 degrees Fahrenheit. Therefore, when the air temperature in the vicinity of the refrigeration system exceeds 95 degrees Fahrenheit, the temperature activated device 500B provides fluid flow through the auxiliary conduits 404 to the nozzles 406.

It can be appreicated that the temperature activated device 500A,B can be placed at various locations associated with the refrigeration unit to control the flow of fluid in numerous ways. The temperature activated device 500A,B of the present invention can be utilized at nine primary locations and the various combinations of each while include, but are not limited to: (1) adjacent the water source, (2) at the bottom of the condensor coil, (3) in the middle of the condensor coil, (4) at the top of the condensor coil, (5) in the fan discharge stream, (6) on top of the compressor, (7) on the compressor discharge line, (8) on the condensor discharge line, and (9) on the compressor suction line. The temperature activated device 500A,B of the present invention can be used in series or in parallel in any of the primary locations previously mentioned and in any other temperature sensitive areas assoviated with the rerigeration system.

The temperature activated device 500A,B of the present invention can be cooled by the spraying of the fluid when the device is in an open mode thereby causing the device to change to the closed mode. Alternately, the temperature activated device 500A,B can be energized by the thermal properties of the air conditioner parts, e.g., the change in temperature with respect to the compressor discharge as well as the change in temperature of the air in the vicinity of the refrigeration system.

Prior to using the temperature responsive cooling apparatus 100, it is preferred that the coil to be cooled using the apparatus 100 is cleaned and coated with a nonfouling material. For example, the coil can be cleaned with acetic acid and coated with silicone. A can of spray silicone or some other nonfouling material is exceedingly convienent for such use. The coil to be cooled should be liberally and completely coated with the nonfouling material.

It is preferred when the temperature responsive cooling apparatus 100 of the present invention is to be used on the same air conditioner or cooling system for long periods of time that the coils be coated with silicone and that the "MICROMET" or a similar treatment material be sufficiently maintained and refilled in the fluid treatment member 300. Although either may prevent the deposition of nonevaporative components in the fluid for damaging the air conditioner or the refrigeration system, preferrably when practicing the present invention over long periods of time both the silicone to coat the coil and the chemicals to treat the water should be used. However, it should be appreciated that the present invention can be readily practiced with out either precleaning the coil or coating the coil with nonfouling material, but without precautions to eliminate the potential fouling problems a significant probability exists that damage may result to the coils of the air conditioner or refrigeration system during longer periods of use.

Alternate embodiments of the same invention are readily adapted using the present disclosure. For example, if more than one nonfouling material were desirable to use because of the dissolution rate, effectiveness, or some other characteristic is affected by temperature, the temperature activated device 500 could be adapted as a temperature switching valve to deliver the desired nonfouling material during the desired interval of temperatures. Thus, it is readily appreciated by a person skilled in the art to connect two or more fluid treatment devices 300 in parallel service, each containing different nonfouling material, and using a temperature activated device 500 to switch between the two or more fluid treatment devices 300.

The present invention is exceedingly easily adapted, as another embodiment, to be utilized from an assembly of components, i.e., assembled from a kit of parts. As can be easily seen, an assemblage of components can be connected together to form the temperature responsive cooling apparatus 100 of the present invention.

It should also be understood that all of the various and sundry components of this invention are well known and conventional per se, and some thereof may have been patented in their own right at sometime in the past. Therefore, it is their interconnection and interactions that effect the new combinations of elements constituting this invention and cause the stated improved results and features to be achieved thereby.

Additional advantages and modifications will readily occur to those skilled in the art. The invention in its broader aspects is therefore not limited to the specific details, representative apparatus, and the illustrative example shown and described herein. Accordingly, departures may be made from the detail without departing from the spirit or the scope of the disclosed general inventive concept.

What is claimed is:

1. A temperature responsive cooling apparatus for an air conditioner or refrigeration system in operative association with a reservoir of fluid, the air conditioner or refrigeration system having an air cooled coil and means for producing a current of air for cooling the coil, the temperature responsive cooling apparatus comprising:

(a) means for transferring the fluid from said reservoir to the air conditioner temperature responsive cooling apparatus, (b) a fluid control device activated by the current of air for cooling the coil, said fluid control device having a pressure responsive means to modulate the pressure of the fluid from the reservoir, for directly engaging the flow of and the pressure of the fluid for restricting the flow of fluid therethrough when the means for producing the current of air for cooling the coil is not operative and for permitting the flow of fluid therethrough when the means for producing the current of air for cooling the coil is operative, (c) a temperature activated, nonelectrical device for terminating and initiating the flow of fluid therethrough in an intermittent fashion for enhancing the operability of the compressor associated with the refrigeration system and for reducing the quantity of fluid required to cool the coil of the refrigeration system, (d) a fluid treatment device for preventing, reducing or mitigating the deposition of nonevaporative components on the air cooled coil, and (e) means for dispersing the fluid to the air cooled coil from said fluid control device for cooling the coil and increasing the efficiency of the air conditioner thereby reducing the cost of operating and maintaining the air conditioner without damaging the air conditioner and without the deposition of nonevaporative components thereupon.

2. The temperature responsive cooling apparatus as defined in claim 1 wherein the fluid comprises water.

3. The temperature responsive cooling apparatus as defined in claim 1 wherein the fluid comprises a fluid having a vapor pressure greater than water.

4. The temperature responsive cooling apparatus as defined in claim 1 further comprising means for cleaning the coil prior to using the temperature responsive cooling apparatus.

5. The temperature responsive cooling apparatus as defined in claim 1 wherein said fluid treatment device comprises:

(a) a housing, (b) an inlet associated with said housing through which the fluid can ingress, (c) an outlet associated with said housing through which the fluid can egress, and (d) means for acting upon the nonevaporative components in the fluid for preventing, reducing or mitigating the deposition of the nonevaporative components on the air cooled coil of the refrigeration system whereby said means for acting upon the nonevaporative components is contained within said housing.

6. The temperature responsive cooling apparatus as defined in claim 5 wherein said means for acting upon the nonevaporative components comprises a treatment medium for preventing, inhibiting or mitigating the deposition of the nonevaporative components on the coil.

7. The temperature responsive cooling apparatus as defined in claim 6 wherein the treatment medium comprises a nonfouling material.

8. The temperature responsive cooling apparatus as defined in claim 7 wherein the nonfouling material comprises the chemical known commercially as and trademarked as "MICROMET."

9. The temperature responsive cooling apparatus as defined in claim 1 wherein said fluid control device comprises:

(a) a casing engaged with the air conditioner for accepting the current of air, (b) a deflector device secured to said casing and actuated by the current of air, and (c) a valve having a pressure responsive means to modulate the pressure of the fluid from the reservoir, for directly engaging the flow of and the pressure of the fluid for controlling the flow therethrough and being directly responsive to said deflector device for closing and for opening said valve whereby said valve is disposed to be closed when said deflector device is not actuated by the current of air, however, when said deflector device is actuated by the current of air then said deflector device actively engages and opens said valve and said valve remains open until said deflector device is not actuated by the current of air.

10. The temperature responsive cooling apparatus as defined in claim 9 wherein said valve comprises:

(a) a flow assembly comprising:

(1) an elongate hollow member having a first end and a second end, (2) an inlet port associated with the first end of the hollow member, (3) an intake chamber integral with the first end of the hollow member and in operative association with the inlet port, (4) a low pressure chamber integral with the second end of the hollow member, the low pressure chamber having an inlet port and an open end, (5) an exhaust chamber integral with the second end of the hollow member and exterior of the low pressure chamber, the exhaust chamber having a closed end, an outlet port and an open end, the open end being concentric with the open end of the low pressure chamber, and (6) a high pressure chamber disposed between and in operative association with the intake chamber and the low pressure chamber, the high pressure chamber having a smaller cross-sectional area than the low pressure chamber;

(b) a flexible gasket separating the low pressure chamber and the exhaust chamber and means for securing the position of the flexible gasket;

(c) a control assembly removably engagable with the second end of the hollow member, said control assembly comprising:

(1) a structure having an abutting end for engaging the hollow member, an outer end and an aperture passing through the structure from the outer end to the abutting end, (2) a pliable gasket operatively associated with the abutting end of the structure and having an aperture therethrough in alignment with the aperture in the structure, (3) a rigid annular member between the abutting end and the pliable gasket, (4) a rod passing through the aperture in the structure and through the aperture in the pliable gasket, (5) a lever operatively associated with the rod and said deflector device for displacing the rod within the apertures in the structure and the pliable gasket, such that when said deflector device is not engaged by the current of air, the lever aided by said deflector device maintains the position of the rod in the control assembly for engaging the pliable gasket, which is capable of withstanding high fluid pressures due to the support of the rigid annular member, for sealing the open ends of both the low pressure chamber and the exhaust chamber thereby preventing the flow of fluid, such that when said deflector device is actuated by the current of air, the lever displaces the rod from the control assembly, disengaging the pliable gasket from the open ends of both the low pressure chamber and the exhaust chamber thereby commencing the flow of fluid through the inlet port, through the intake chamber, through the high pressure chamber through the low pressure chamber, by the pliable gasket, through the exhaust chamber and out the outlet, and such that when said deflector device is again not engaged by the current of air, the lever replaces the rod into the control assembly, engaging the pliable gasket which, aided by the rigid annular member, forms a seal with the open ends of both the low pressure chamber and the exhaust chamber thereby preventing the flow of fluid.

11. The temperature responsive cooling apparatus ad defined in claim 1 wherein said temperature activated device comprises:

(a) a temperature sensitive element, and (b) a valve element in operative relation to said temperature sensitive element for restricting and for permitting the flow of fluid based upon the ambient temperature in association with the temperature sensitive element.

12. The temperature activated device as defined in claim 11 wherein said temperature sensitive element comprises a commercially available thermostatic actuator.

13. The temperature activated device as defined in claim 11 wherein said temperature sensitive element comprises:

(a) a temperature sensitive element comprising:

(1) an actuator member having therein a thermally sensitive material which undergoes volumetric contraction or expansion with changes in ambient temperature, and (2) a shaft in operative association with said actuator member for providing piston-type movement in response to the volumetric changes in the thermally sensitive material; and (b) a valve mechanism comprising:

(1) a sleeve engaged with the temperature sensitive element, (2) a body having a fluid inlet, a fluid outlet and a channel having the first end and the second end, and (3) a stem assembly comprising: (A) a shaft having a cap end and an expanded end, (B) a spring, (C) a washer, (D) a first seal operatively associated with the expanded end of the shaft, the fluid inlet and the first end of the channel, and (E) a second seal operatively associated with the washer, the spring, the cap end of the shaft and the second end of the channel, such that the second seal secures the second end of the channel preventing fluid from passing therethrough and the first seal intermittently secures the first end of the channel when the shaft of the temperature sensitive element is withdrawn therein and is expelled therefrom due to changes in the ambient temperature, thereby providing the intermittent flow of fluid through the fluid inlet and the fluid outlet.

14. A temperature responsive cooling apparatus for an air conditioner or refrigeration system, the air conditioner or refrigeration system having an air cooled coil and means for producing a current of air for cooling the coil, the temperature responsive cooling apparatus comprising:

(a) a reservoir of fluid, (b) means for transferring the fluid from said reservoir to the temperature responsive cooling apparatus, (c) a fluid control device mounted on the air conditioner and activated by the current of air for cooling the coil, said fluid control device having a pressure responsive means to modulate the pressure of the fluid from the reservoir, for directly engaging the flow of and the pressure of the fluid for restricting the flow of fluid therethrough when the means for producing the current of air for cooling the coil is not operative and for permitting the flow of fluid therethrough when the means for producing the current of air for cooling the coil is operative, wherein said fluid control device comprises:

(1) a casing engaged with the air conditioner for accepting the current of air, (2) a deflector device secured to said casing and actuated by the current of air, and (3) a valve having a pressure responsive means to modulate the pressure of the fluid from the reservoir, for directly engaging the flow of and the pressure of the fluid for controlling the flow therethrough and being directly responsive to said deflector device for closing and for opening said valve, said valve is disposed to be closed when said deflector device is not actuated by the current of air, however, when said deflector device is actuated by the current of air then said deflector device actively engages and opens said valve and said valve remains open until said deflector device is not actuated by the current of of air, wherein said valve comprises:

(A) a flow assembly comprising:

(1) an elongate hollow member having a first end and a second end, (2) an inlet port associated with the first end of the hollow member, (3) an intake chamber integral with the first end of the hollow member and in operative association with the inlet port, (4) a low pressure chamber integral with the second end of the hollow member, the low pressure chamber having an inlet port and an open end, (5) an exhaust chamber integral with the second end of the hollow member and exterior of the low pressure chamber, the exhaust chamber having a closed end, an outlet port and an open end, the open end being concentric with the open end of the low pressure chamber, and (6) a high pressure chamber disposed between and in operative association with the intake chamber and the low pressure chamber, the high pressure chamber having a smaller cross-sectional area than the low pressure chamber;

(B) a flexible gasket separating the low pressure chamber and the exhaust chamber and means for securing the position of the flexible gasket;

(C) a control assembly removably engagable with the second end of the hollow member, said control assembly comprising:

(1) a structure having an abutting end for engaging the hollow member, an outer end and an aperture passing through the structure from the outer end to the abutting end, (2) a pliable gasket operatively associated with the abutting end of the structure and having an aperture therethrough in alignment with the aperture in the structure, (3) a rigid annular member between the abutting end and the pliable gasket, (4) a rod passing through the aperture in the structure and through the aperture in the pliable gasket, (5) a lever operatively associated with the rod and said deflector device for displacing the rod within the apertures in the structure and the pliable gasket, such that when said deflector device is not engaged by the current of air, the lever aided by said deflector device maintains the position of the rod in the control assembly for engaging the pliable gasket, which is capable of withstanding high fluid pressures due to the support of the rigid annular member, for sealing the open ends of both the low pressure chamber and the exhaust chamber thereby preventing the flow of fluid, such that when said deflector device is actuated by the current of air, the lever displaces the rod from the control assembly, disengaging the pliable gasket from the open ends of both the low pressure chamber and the exhaust chamber thereby commencing the flow of fluid through the inlet port, through the intake chamber, through the high pressure chamber, through the low pressure chamber, by the pliable gasket through the exhaust chamber and out the outlet, and such that when said deflector device is again not engaged by the current of air, the lever replaces the rod into the control assembly, engaging the pliable gasket which, aided by the rigid annular member, forms a seal with the open ends of both the low pressure chamber and the exhaust chamber thereby preventing the flow of fluid.

15. A combination of components adapted for assembly together as a temperature responsive cooling apparatus for providing additional cooling to an air conditioner or a refrigeration system, for increasing the efficiency of the air conditioner or refrigeration system and for reducing the cost of operating and maintaining the air conditioner or refrigeration system without damaging and without depositing nonevaporative components on the air conditioner or refrigeration system, the air condition or refrigeration system having an air cooled coil and means for producing a current of air for cooling the coil, the components of the temperature responsive cooling apparatus comprising as cooperative parts thereof:

(a) a conduit for transferring a fluid from a reservoir, (b) a fluid control device for mounting on the air conditioner and for the current of air for cooling the coil to activate, said fluid control device having a pressure responsive means to modulate the pressure of the fluid from the reservoir, for directly engaging the flow of and the pressure of the fluid transferred by said conduit for restricting the flow of fluid when the means for producing the current of air for cooling the coil is not operative and for permitting the flow of fluid when the means for producing the current of air for cooling the coil is operative, (c) a treatment device in operative association with said conduit and said fluid control device for substantially removing the nonevaporative components from the fluid, (d) a temperature activated device for terminating and initiating the flow of fluid therethrough in an intermittent fashion for enhancing the operability of the compressor associated with the refrigeration system and for reducing the quantity of fluid required to cool the coil of the refrigeration system, (e) a spray device for spraying silicone on the air cooled coil for preventing the deposition of nonevaporative components thereupon, (f) one or more conduits for transferring the fluid to the air cooled coil for cooling the coil and for increasing the efficiency of the air conditioner, such that the spray device is used to spray silicone on the air cooled coils, the fluid control device is mounted on the air conditioner to be directly engaged by the means for producing the current of air for cooling the coil, the treatment device is connected to the fluid control device, the conduit is connected at one end to the treatment device and at the other end to the reservoir, the conduits for transferring fluid to the air cooled coils are connected at one end to the fluid control device and at the other end to the spray nozzels, the spray nozzels are affixed to the air conditioner to direct the flow of fluid through the nozzels on the air cooled coil, such that fluid passes from the reservoir through the conduit through the treatment device and directly engages the fluid control device, if the fluid control device is not activated by the current of air from the air conditioner then the fluid is restricted from flowing further, if the fluid control device is activated by the current of air from the air conditioner then the fluid passes through the fluid control device through the one or more conduits to the spray nozzels through the spray nozzels and on to the silicone covered air cooled coils for cooling the coils when the air conditioner is operative and the air cooled coils are in use thereby reducing the cost of operating and maintaining the air conditioner without damaging the air conditioner and without the deposition of nonevaporative components thereupon.

16. The combination of components adapted for assembly together as a temperature responsive cooling apparatus as defined in claim 15 wherein said fluid treatment device comprises:

(a) a housing, (b) an inlet associated with said housing through which the fluid can pass, (c) an outlet associated with said housing through which the fluid can pass, and (d) means for acting upon the nonevaporative components in the fluid for preventing the deposition of the nonevaporative components on the air cooled coil of the air conditioner whereby said means for acting upon the nonevaporative components is contained within said housing.

17. The combination of components adapted for assembly together as a temperature responsive cooling apparatus as defined in claim 16 wherein said means for acting upon the nonevaporative components comprises a treatment medium for preventing, inhibiting or mitigating the deposition of the nonevaporative components on the coil.

18. The combination of components adapted for assembly together as a temperature responsive cooling apparatus as defined in claim 17 wherein the treatment medium comprises the chemical known commercially as and trademarked as "MICROMET."

19. The combination of components adapted for assembly together as a temperature responsive cooling apparatus as defined in claim 15 wherein said fluid control device comprises:

(a) a casing engaged with the air conditioner for accepting the air conditioner, (b) a deflector device secured to said casing actuated by the current of air, and (c) a valve having a pressure responsive means to modulate the pressure of the fluid from the reservoir, for directly engaging the flow of and the pressure of the fluid for controlling the flow therethrough and being directly responsive to said deflector device for closing and for opening said valve whereby said valve is disposed to be closed when said deflector device is not actuated by the current of air, however, when said deflector device is actuated by the current of air then said deflector device actively engages and opens said valve and said valve remains open until said deflector device is not actuated by the current of air.

20. The combination of components adapted for assembly together as a temperature responsive cooling apparatus as defined in claim 15 wherein said temperature activated device comprises:

(a) a temperature sensitive element, and (b) a valve element in operative relation to said temperature sensitive element for restricting and for permitting the flow of fluid based upon the ambient temperature in association with the temperature sensitive element.

* * * * *